US005941408A

United States Patent [19]

Sherman

[11] Patent Number: 5,941,408

[45] Date of Patent: Aug. 24, 1999

[54] CONTAINER LINER WITH INTEGRAL HANDLE COVER

[75] Inventor: Barbara A. Sherman, Chambersburg, Pa.

[73] Assignee: The Longaberger Company, Newark, Ohio

[21] Appl. No.: 08/902,671

[22] Filed: Jul. 31, 1997

[51] Int. Cl.[6] ..... B65D 90/04

[52] U.S. Cl. ..... 220/495.01; 220/9.4

[58] Field of Search ..... 220/495.01, 9.4, 220/755

[56] References Cited

U.S. PATENT DOCUMENTS

| | | | |
|---|---|---|---|
| 1,965,138 | 7/1934 | Dunlap | 220/495.01 X |
| 2,529,267 | 11/1950 | Sloane | 220/9.4 X |
| 2,544,075 | 3/1951 | Ernst et al. | 220/495.01 X |
| 4,735,340 | 4/1988 | Preston | 220/495.1 |
| 5,097,979 | 3/1992 | McDermott et al. | 220/495.01 |
| 5,240,134 | 8/1993 | McDermott et al. | 220/495.01 X |
| 5,310,077 | 5/1994 | McDermott et al. | 220/495.01 X |

OTHER PUBLICATIONS

The Longaberger Company, *Holiday Treasures* flyer, approx. Aug. 1994, p. 10, and *WishList*, Sep. 1995, p. 13, Ruffled Handle Gripper (shown on baskets with two swinging handles).

*Primary Examiner*—Steven Pollard
*Attorney, Agent, or Firm*—Porter, Wright, Morris & Arthur

[57] ABSTRACT

A liner for use with a container having a slot in a side wall that defines a handle. The liner comprises a liner body having an opening in a side region thereof. A flap extends from a position above the opening a distance sufficient to allow the flap to be wrapped around the handle. The flap may be folded downwardly over the exterior of the handle, inwardly through the slot and under the bottom of the handle, and upwardly over the interior of the handle to form a cover for the handle. Part or all of the flap may be padded to cushion the handle. The liner may include a fastener, such as a hook and loop closure, for releasably fastening the flap to the liner body around the handle, thereby securing the liner to the container.

20 Claims, 4 Drawing Sheets

CONTAINER LINER WITH INTEGRAL HANDLE COVER

BACKGROUND OF THE INVENTION

The present invention relates to a liner for a container having a slot in a side wall that defines a handle, and more particularly, to a liner having an integral handle cover.

Containers having a slot in a side wall that defines a handle ("slot-handled containers") find favor with users because the handle provides a convenient place for gripping the container without occupying additional space or requiring the use of additional components. In these containers, a slot is provided at a distance from the top rim. The portion of the side wall extending between the top rim and the upper edge of the slot forms the handle.

Liners frequently are used inside containers to prevent contact between the contents of the container and the inner surface of the container, or to provide a softer or smoother surface within the container. When the container has interstices or perforations, a liner also may provide a barrier to the passage of liquids or small objects such as coins or paper clips through these container openings. Liners also may increase the usefulness of the container by providing compartments for convenient storage of small items.

Liners typically have not been used with slot-handled containers because conventional liners interfere with the use of the handle. Even when an opening is provided in the liner in a position corresponding to the slot, the liner is susceptible to sagging or being shifted out of position when the container is handled.

The weight-bearing surface of a slot handle (i.e., the upper edge of the slot) generally is only as wide as the thickness of the container wall. This narrow weight-bearing surface may result in discomfort to a user as the bottom edge of the handle (upper edge of the slot) presses into the user's hand, particularly when the container is heavily loaded.

Handle covers or "grippers" sometimes are used to provide a handle with a softer or smoother gripping surface. The grippers, which generally are formed from a strip of fabric or other flexible material, are wrapped around the handle (or even adjacent handles. The grippers typically have fasteners affixed to opposing surfaces so that the grippers may be secured to the handle(s). Often, padding is applied to part or all of the gripper to further cushion the handle(s).

Although grippers accomplish the objective of improving the gripping surface of the container, the grippers are small and therefore prone to being lost or misplaced when they are removed from the containers. Grippers, which are not attached in any way to a container liner, also play no role in securing the liner to the container.

SUMMARY OF THE INVENTION

It is an object of the present invention to provide a liner that may be secured to the handle of a slot-handled container.

It is also an object of this invention to provide a liner for use with a slot-handled container in which the liner includes an integral handle cover.

It is another object of this invention to provide a lined container in which a liner including an integral handle cover is received in a slot-handled container.

Fulfilling these objectives, the liner comprises a liner body having an opening in a side region thereof. The opening is sized to accommodate the partial insertion of a user's hand and preferably occupies a position corresponding to the position of the slot.

A flap extends from a position above the opening a distance sufficient to allow the flap to be wrapped around the handle. The flap may be folded downwardly over the exterior of the handle, inwardly through the slot past the bottom of the handle, and upwardly over the interior of the handle. If desired, the wrapping of the flap around the handle may continue, with the flap overlapping itself, until the handle has been encircled a desired number of time. Part or all of the flap may be padded to cushion the handle.

The liner may include a fastener, such as a hook and loop closure, for releasably fastening the flap to the liner body. When the flap engages the handle as described above and the flap is releasably fastened to the liner body around the handle, the engagement of the handle by the flap secures the liner to the container and assists in maintaining the liner in a desired position within the container.

The lined container includes a container in which the handle is formed by a portion of the side wall extending between the top rim and the upper edge of a slot spaced a distance from the top rim. A liner, which defines an opening in a side portion thereof, is received within the container. A flap that is capable of being wrapped around the handle extends from the liner above the opening. The flap may be releasably fastened to the liner after the flap is wrapped around the handle. As described above, the flap may be capable of securing the liner to the container and cushioning the handle.

These and further objects of the invention will become apparent from the following detailed description.

DETAILED DESCRIPTION OF PREFERRED EMBODIMENT(S)

The present invention comprises a liner for use with a container having a handle formed by a portion of the container wall that extends between the container rim and the upper edge of a slot spaced a distance from the rim. The liner has an opening in a side region thereof, which preferably is positioned to correspond with the position of the slot when the liner is received in the container. A flap extends from a position above the opening a distance sufficient to allow the flap to be wrapped around the handle. The flap, which is folded downwardly over the exterior of the handle, inwardly through the slot past the bottom of the handle, and upwardly over the interior of the handle, forms a cover for the handle. The invention also includes a lined container in which the liner described above is received in the container.

The liner of the present invention may be used with containers without lids, as well as those with separate or attached lids. If the liner is used with a lidded container in which the lid extends into the interior of the container, the lid should be sized so that it does not bind when it comes into contact with the liner, and particularly the flap and any cuff. Particular embodiments of the invention may be described or shown with reference to containers that are baskets, although the liner may be used satisfactorily with other types of containers with slot handles as well.

Figure 1:
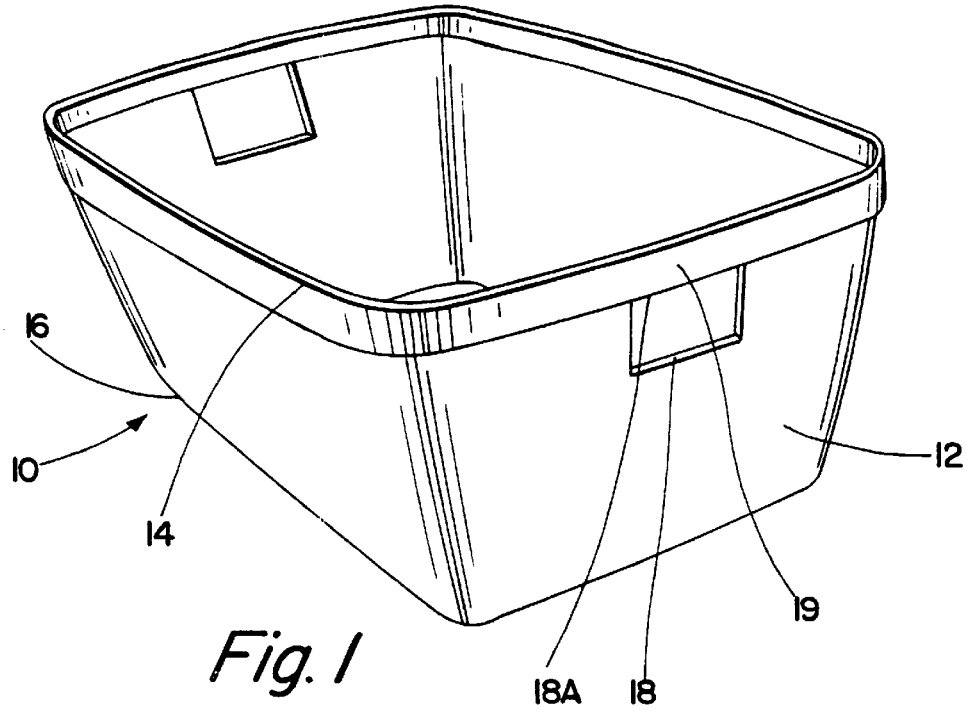
FIG. 1 is a perspective view of a slot-handed container with which the liner of the present invention may be used.

Turning now to the drawings, FIG. 1 shows a slot-handled container 10 in connection with which the liner of the present invention is useful. The container 10 has a side wall 12 extending from a top rim 14 to a base 16. A slot 18 is formed in the wall 12 at a distance below the rim 14. As described further below, the slot 18 preferably has a flat top. The slot 18 commonly is rectangular in shape, particularly in woven wood baskets. However, slots having other shapes, such as a U-shape (a flat top with a curved bottom), also may be used in certain types of containers.

The slot 18 defines a passage through the wall 12 sized to allow a user to partially insert a hand (the partial insertion usually including the fingers and perhaps a portion of the palm but not the thumb) into the slot 18. The wall portion extending from the upper edge 18A of the slot to the top rim 14 defines a handle 19. Such handles may be referred to as "cut-out" handles, although the handles are not always formed by cutting out the material of the side wall.

A user typically grasps the handle 19 by orienting the palm toward the exterior side wall 12 of the container 10, inserting the fingers into the slot 18 and bending the fingers upwardly around the wall portion above the slot 18. Thus, the primary weight-bearing surface of the handle 19 is the bottom surface of the upper edge 18A of the slot 18. Preferably, the top rim 14 and the upper edge 18A of the slot are flat and substantially parallel for ease in gripping, but the presence of a slight curvature in either or both of them would still result in a usable handle.

The top rim 14 and the upper edge 18A of the slot are spaced apart a distance that allows a user to comfortably grip the handle. A handle height of about 1 inch is commonly used in large (about 27×17×10 inches) containers, although this dimension may vary to some extent with the size and intended use of the container.

Figure 2:
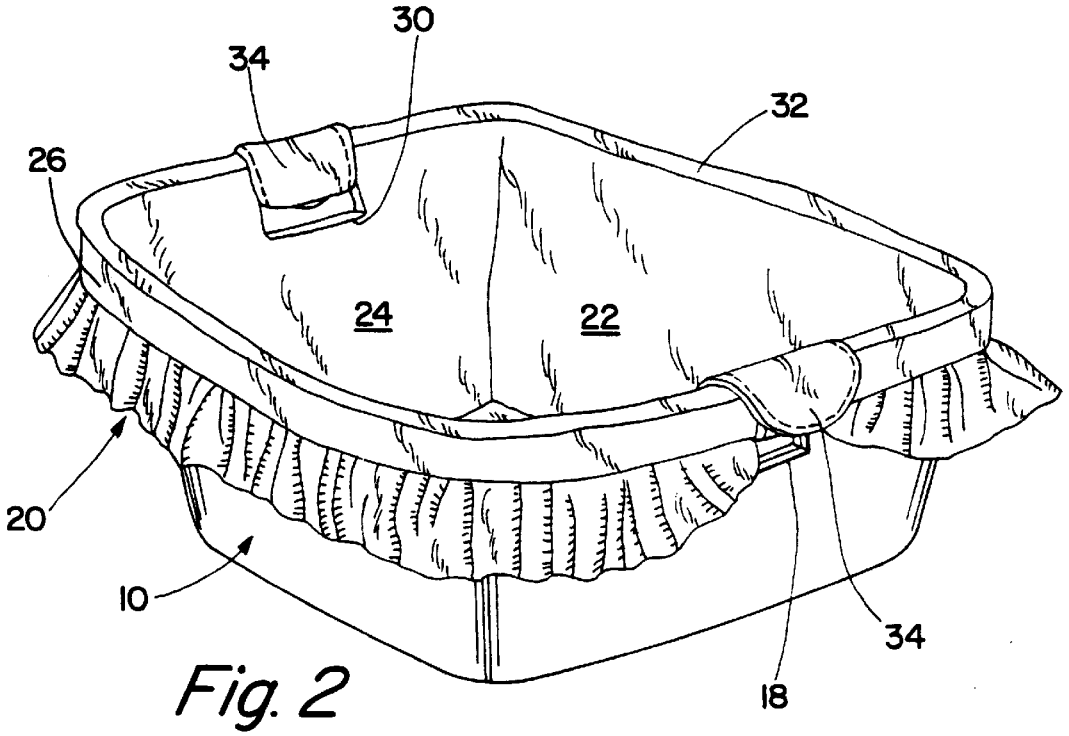
FIG. 2 is a perspective view of the liner of the present invention received in the container of FIG. 1.

FIG. 2 shows the liner 20 of the present invention received within the container 10. The liner 20 includes a liner body 22, which preferably conforms substantially to the interior of the container 10.

The liner body 22 has side regions or panels 24 that extend upwardly toward the top rim 14 of the container 10. The sides may end at about the same level as, or a short distance below, the top rim of the container (not shown in the drawings). In another embodiment, the liner body 22 may include a cuff 26 that folds over the top rim 14 of the container 10 and covers a portion of the exterior of the container 10. The cuff 26 may cushion the top rim of the container. The cuff 26 must not be so deep in the area of the handle 19 to interfere with the handle 19; however, when a deep cuff 26 is desired, the cuff 26 may define a recess 28 in the handle area so that this does not occur, best shown in FIG. 4.

Figure 7:
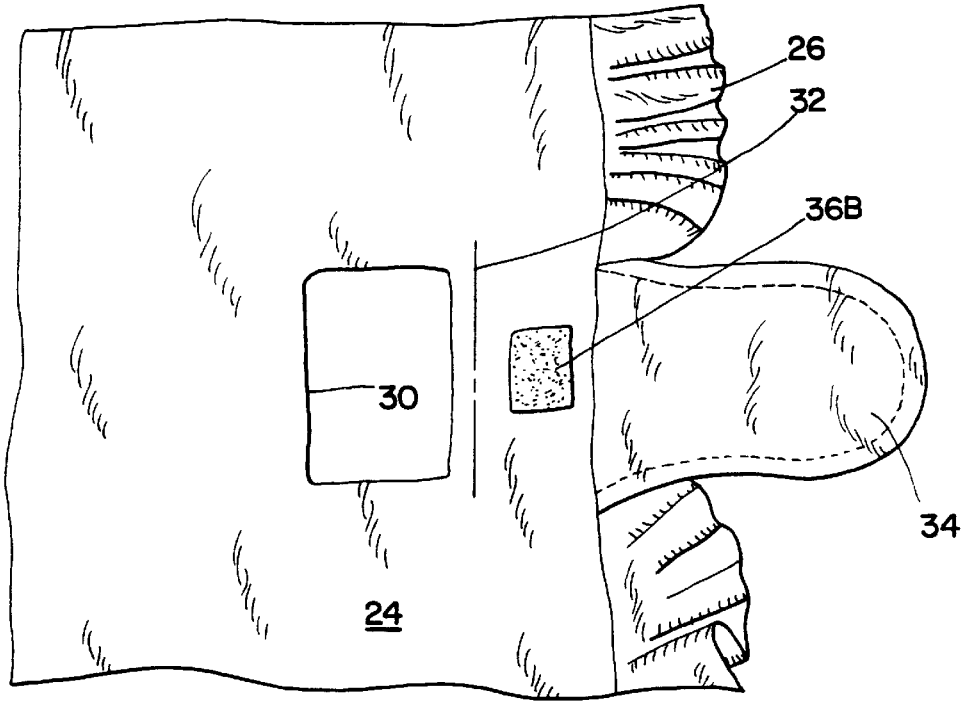
FIG. 7 is a partial view of one side of the liner showing a side portion with opening and flap.

The liner body 22 has a opening 30 in its side region 24 that is spaced a distance from the top edge 32 (indicated by a dotted line in FIG. 7). The shape and size of the opening 30 preferably conform substantially to the shape and size of the slot 18 so that the liner 20 does not interfere with use of the handle 19. Most commonly, the opening 30 is rectangular in shape, but other shapes also may be used, provided that they readily accommodate the insertion and removal of part of the user's hand. It is desirable, although not necessary, to provide an opening for each slot present in the container.

A flap or elongated tab 34 extends from the body 22 from a position above the opening 30. In a preferred embodiment, the flap 34 extends from a position on the body 22 that is at or near the top rim 14 of the container 10 when the liner 20 is received within the container 10. However, the flap 34 may extend from any position above the opening 30, that is, from the area from the upper edge of the opening 30 to the top edge 32 of the liner body, including the top edge of an uncuffed liner. If desired, flaps may be provided for each opening in the liner.

Figure 8:
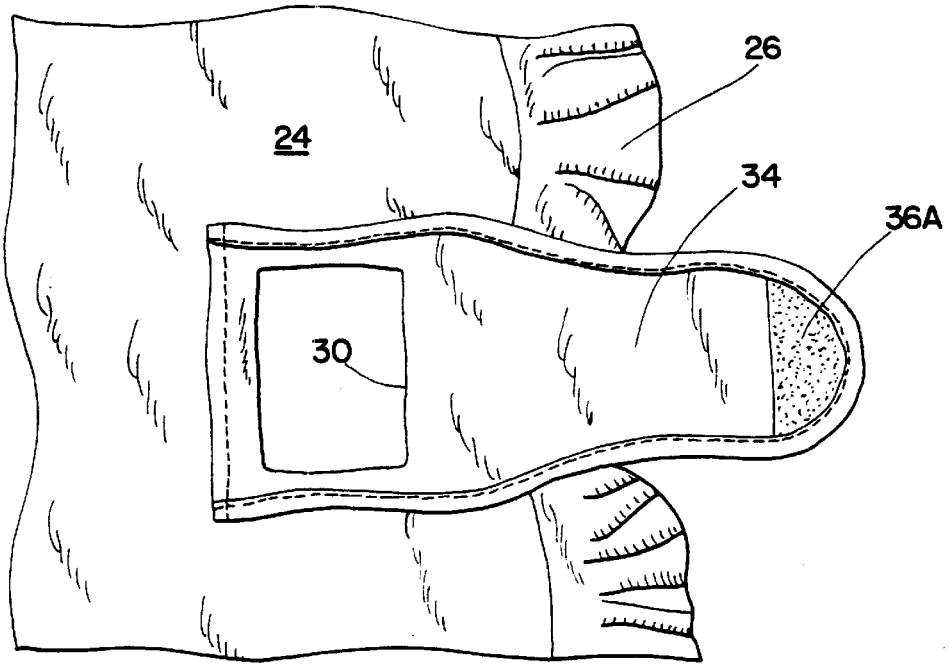
FIG. 8 is a partial view of the other side of the liner of FIG. 7.

In a preferred embodiment, the flap 34 is formed separately from the liner body 22 and is secured to the liner body 22 by stitching, as shown in FIGS. 7 and 8. A portion of the material from which the flap 34 is formed may cooperate with the liner body 22 to form a finished edge of the opening, or to reinforce the opening 30. The flap also may be continuous with the liner body (not shown in the drawings).

Figure 3:
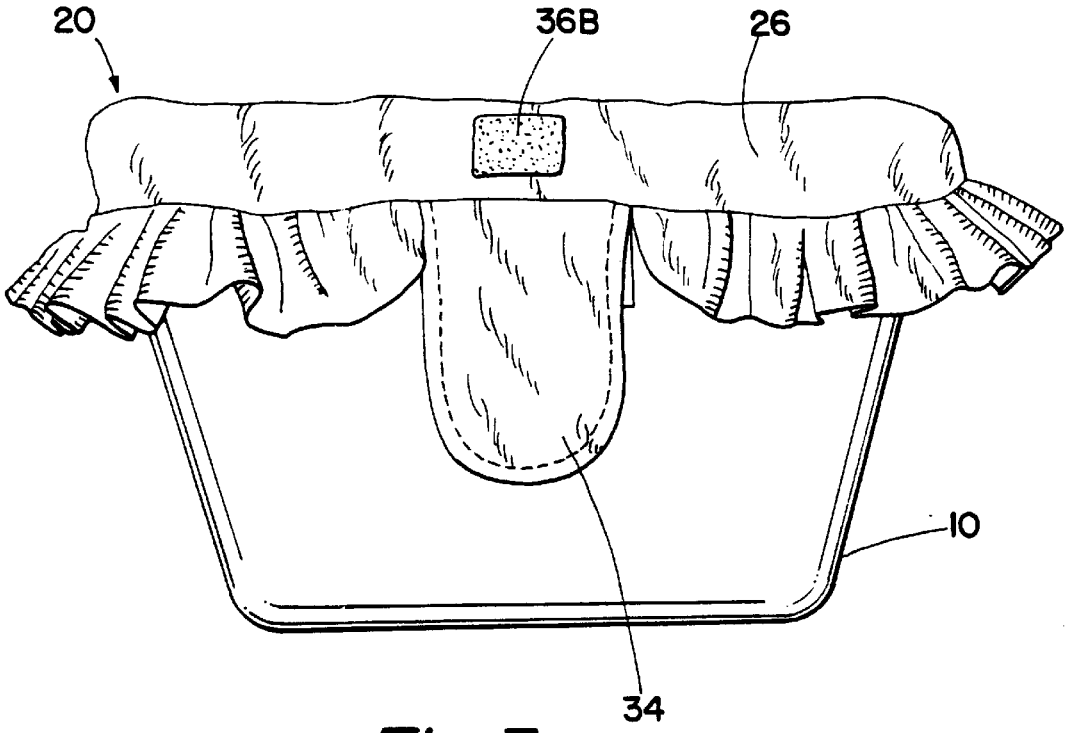
FIG. 3 is an end view of the container and liner of FIG. 2 before the flap of the liner has been inserted through the slot.

In a basket with a handle height of about one inch, the flap 34 preferably would extend about 7 inches from the top of the opening 30 (see FIG. 3) so that the flap 34 is long enough to wrap around the handle 19 with the end of the flap 34 terminating on the outside of the handle 19. (See FIG. 4.) However, the flap length may vary somewhat depending on the thickness of the fabric, the characteristics of any optional padding used, the type and placement of the fasteners and the degree of overlap desired.

Figure 4:
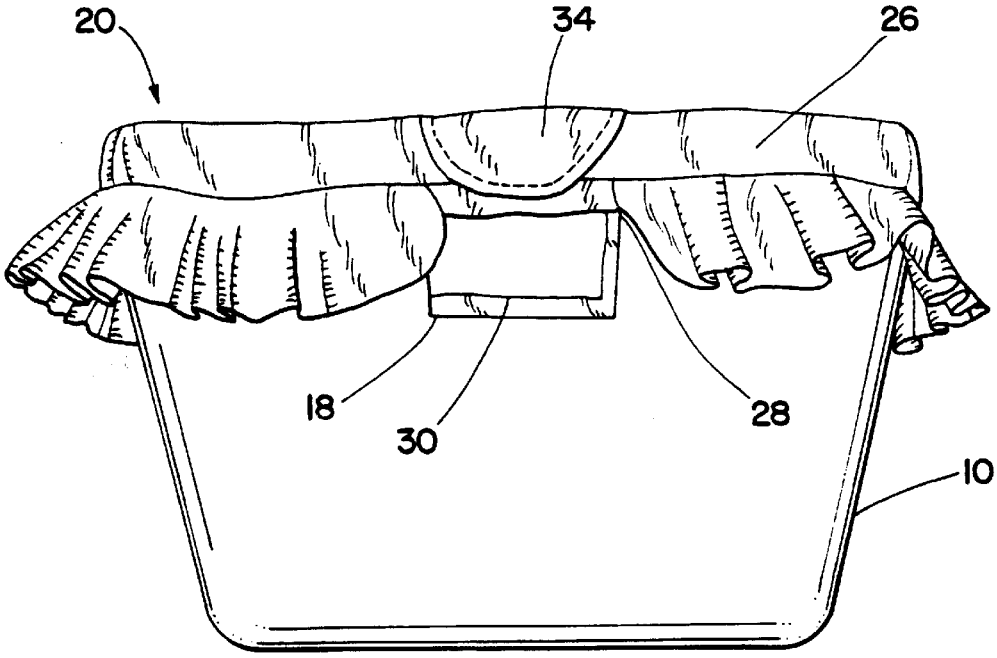
FIG. 4 is an end view of the container and liner of FIG. 2 after the flap of the liner has been inserted into the slot and wrapped around the handle.
Figure 6:
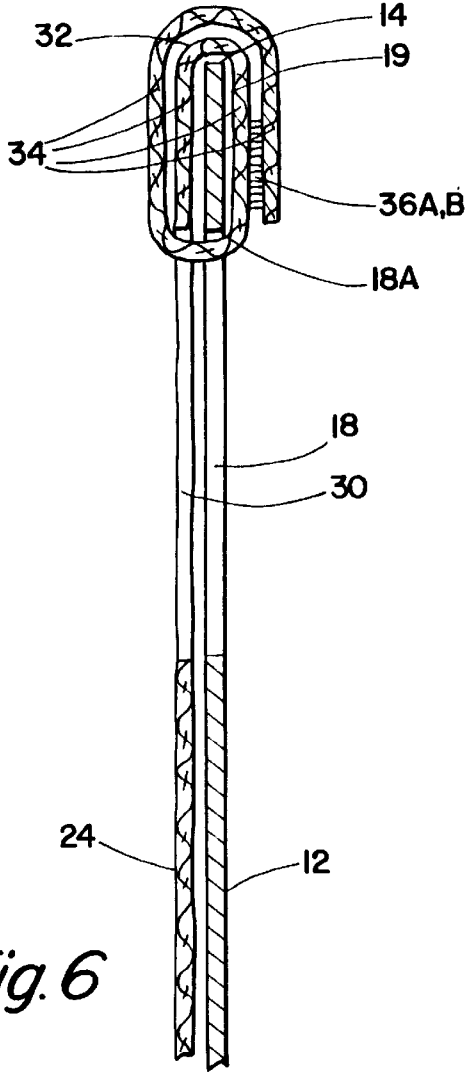
FIG. 6 is a partial side sectional view through the center of the container handle showing the liner flap wrapped around the handle.
Figure 5:
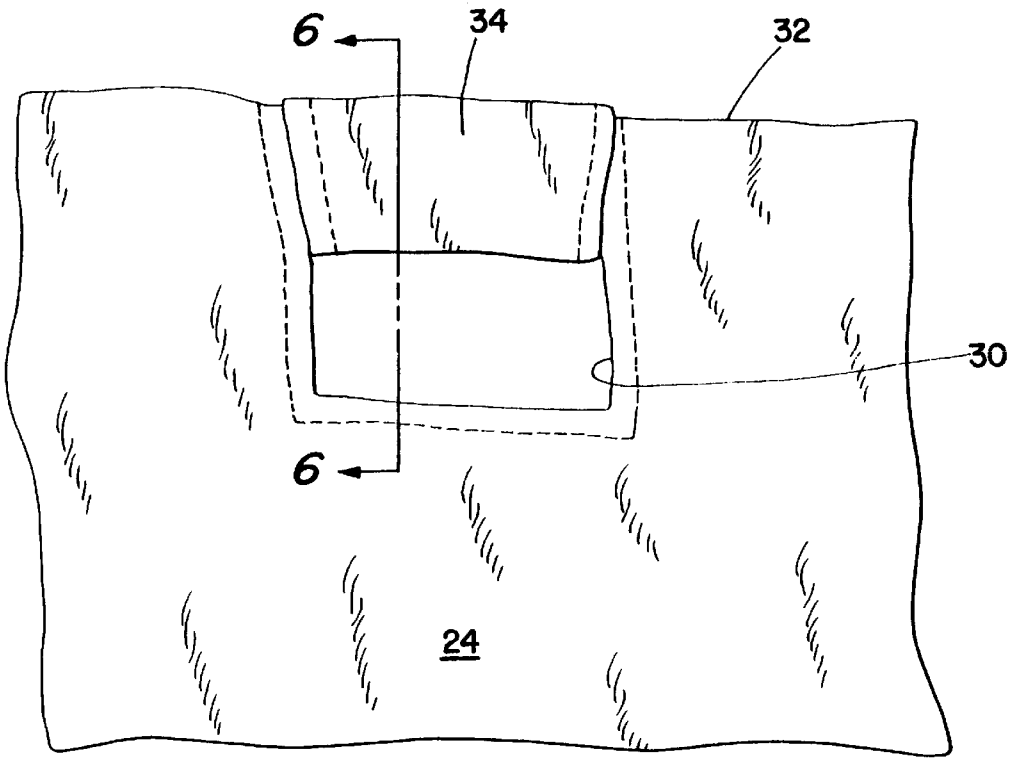
FIG. 5 is another (partial) end view of the container and liner of FIG. 4.

The flap 34 is wrapped around the handle 19 to form a cover that cushions the handle 19. This is accomplished by folding the flap 34 downwardly over the exterior of the handle 19, inwardly through the slot 18 past the bottom of the handle 18A, and upwardly over the interior of the handle 19, as shown in FIGS. 4–6. If desired and the flap length permits, the wrapping of the flap 34 around the handle 19 may continue, with the flap 34 overlapping itself until the handle 19 has been encircled a desired number of times.

The flap may include padding (not shown in the drawings) to cushion the handle and prevent any hard or sharp edges from digging into a user's hand, particularly when the container is heavily loaded. Padding may be provided along the entire length of the flap or in a more limited area corresponding to the bottom edge of the slot. The padding may be formed from any suitable material, such as polyester fiber batting or the like.

The liner 20 may include a fastener 36 for releasably securing the flap 34 to the liner 20. Typically, a fastener 36A is provided on the end of the flap 34 and a corresponding fastener 36B is provided at a lower position (closer to the liner body 22) on the other side of the flap 34 or on the liner body 22 itself. The fasteners 36 may be hook and loop fasteners, buttons and buttonholes, snaps, ties, or any other items suitable for releasably fastening the flap 34 to the liner 20. When the liner 20 is received within a slot-handled container 10, the flap 34 may engage the handle 19 as described above and be fastened to the liner body 22 around the handle 19, thereby securing the liner 20 to the container 10 and maintaining it in a desired position within the container 10.

The liner body 22 and flap 34 preferably are formed from a sturdy, flexible material, most typically, fabric. The material should resist the abrasion expected from contact with the handle.

The liner body 22 may be constructed by conventional methods such as those well known in the field of fabric linings for baskets. Preferably, the body 22 is constructed so that it will substantially conform to the interior of the container 10. For example, the liner may include a base and side panels, which may be attached to or integral with the base. For a rectangular container, the liner body may be formed from a base and four side panels, each attached to the two adjacent side panels and the base. The liner body also may be formed from a base having elongated extensions that continue upwardly to form opposing sides, with two separate side panels connected to the side extensions and the base. For an oval or round container, the body may include a base and one or more sections joined to define a cylindrical side panel.

Of course, the liner body also may be formed from a single sheet of fabric or the like, with or without gathers, pleats or tucks to adjust the fullness of the liner relative to the container. The presence of some excess fabric in the liner body is unlikely to have a marked effect on performance unless the fabric is unusually heavy or stiff, although the excess fabric may be unsightly.

Preferably, the fabric is oriented so that the "wrong" side, if any, faces the container interior to provide a more attractive appearance when looking into the container, and the edges are finished, by hemming, binding, or similar techniques. The liner body also may be provided with a lining so that the wrong side of the fabric is not exposed and all of the seams and edges have a finished appearance.

As described above, the flap 34 may be continuous with the liner body 22 or formed from a separate price of fabric and securely sewn or otherwise attached to the liner body 22. Preferably, the edges of the flap 34 are finished to prevent ravelling or fraying. Although this may be accomplished by hemming or binding the edges, the most satisfactory results will be achieved it the flap 34 is lined. The lining material also provides additional cushioning of the handle 19. Binding may be added to a lined flap 34 as shown in FIGS. 7 and 8.

It is possible to construct a separate flap from a different material than that used for the liner body. However, the use of the same type of fabric, or at least one with similar characteristics, including composition, weight, body and washability, will yield superior results.

Although specific embodiments of the invention have been described herein in detail, it is understood that variations may be made thereto by those skilled in the art without departing from the spirit of the invention or the scope of the appended claims.

I claim:

1. A liner for a container having a side wall extending from a top rim to a container base, the side wall having a slot spaced a distance from the top rim, the wall portion extending from the top rim to the upper edge of the slot defining a handle, the liner comprising:

a liner body defining an opening in a side region thereof, a flap extending from a position above the opening a distance sufficient to allow the flap to be wrapped around the handle.

2. The liner according to claim 1, wherein the flap includes a fastener.

3. The liner according to claim 2, wherein the fastener is a hook and loop closure.

4. The liner according to claim 1, wherein the flap is releasably fastened to the liner body after wrapping around the handle.

5. The liner according to claim 4, wherein the flap is capable of securing the liner to the container.

6. The liner according to claim 1, wherein the flap is padded.

7. The liner according to claim 1 wherein the flap is integral with the liner body.

8. The liner according to claim 1, wherein the flap is attached to the liner body by stitching.

9. The liner according to claim 1, wherein the liner body includes a cuff that folds over the top rim of the container and covers a portion of the exterior of the container.

10. The liner according to claim 1, wherein the opening is sized to accommodate the partial insertion of a user's hand.

11. The liner according to claim 1, wherein the opening is rectangular.

12. The liner according to claim 1, wherein the position of the opening corresponds to the position of the slot.

13. A liner for a container having a side wall extending from a top rim to a container base, the side wall having a slot spaced a distance from the top rim, the wall portion extending from the top rim to the upper edge of the slot defining a handle, the liner comprising:

a liner body having a side panel extending from a top edge to a bottom panel, the side panel defining an opening spaced a distance from the top edge and capable of being aligned with the slot; and a flap extending upwardly from the top edge of the liner body, the flap being capable of folding downwardly over the exterior of the handle, under the bottom of the handle, and upwardly over the interior of the handle.

14. The liner according to claim 13, wherein the liner body comprises a fabric sheet.

15. The liner according to claim 13, wherein the liner body comprises a base and a predetermined number of side panels each connected to two adjacent side panels and the base.

16. A lined container, comprising:

a container having a side wall extending from a top rim to a container base, the side wall having a slot spaced a distance from the top rim, the wall portion extending from the top rim to the upper edge of the slot defining a handle; and a liner defining an opening in a side portion thereof, a flap extending from the liner from above the opening, the flap capable of being wrapped around the handle.

17. The liner according to claim 16, wherein the flap engages the handle, the engagement of the handle by the flap securing the liner to the container.

18. The lined container according to claim 16, wherein the flap is releasably fastened to the liner after being wrapped around the handle.

19. The lined container according to claim 17, wherein the flap is capable of securing the liner to the container.

20. The lined container according to claim 17, wherein the flap cushions the handle.

* * * * *